United States Patent [19]

Zinga et al.

[11] 4,039,167

[45] Aug. 2, 1977

[54] HYDRAULIC VIBRATOR

[75] Inventors: William L. Zinga, Saratoga, Calif.; Raymond C. Thompson, Lisle, Ill.

[73] Assignee: Zinga Industries Inc., Bellwood, Ill.

[21] Appl. No.: 711,092

[22] Filed: Aug. 2, 1976

[51] Int. Cl.[2] ..... B01F 11/00

[52] U.S. Cl. ..... 259/1 R; 259/DIG. 43

[58] Field of Search ..... 259/1 R, DIG. 43; 425/456; 74/87

[56] References Cited

U.S. PATENT DOCUMENTS

| | | | |
|---|---|---|---|
| 2,215,888 | 9/1940 | Swarthout | 259/1 R |
| 2,763,472 | 9/1956 | Fontaine | 259/DIG. 43 |
| 3,162,426 | 12/1964 | Fontaine | 259/1 R |
| 3,948,354 | 4/1976 | Fosse | 425/456 |

*Primary Examiner*—Edward J. McCarthy
*Attorney, Agent, or Firm*—Wegner, Stellman, McCord, Wiles & Wood

[57] ABSTRACT

A fluid-operated vibrator having improved structure for lubricating the bearings of an eccentric portion thereof. A portion of the pressurized fluid delivered to the drive motor of the vibrator is bypassed through the drive shaft of the motor. After lubricating the bearings, the lubricant fluid is returned to the exhaust fluid line. The bypass passage may effectively define a pressure drop restrictor for improved lubrication of the bearings. The inlet and outlet to the motor may be connected to a conduit structure having an outer exhaust conduit and a supply conduit extending longitudinally within the exhaust conduit.

16 Claims, 2 Drawing Figures

HYDRAULIC VIBRATOR

BACKGROUND OF THE INVENTION

1. Field of the Invention

This invention relates to vibrators and in particular to fluid-operated vibrators.

2. Description of the Prior Art

In U.S. Pat. No. 2,215,888, of Gerald F. Swarthout, a vibrator structure is disclosed wherein a portion of the hydraulic fluid driving the hydraulic motor escapes inot a lower portion of the casing so as to lubricate the bearings. The casing is open to the exhaust conduit so that the pressure of the lubricant in the casing is at exhaust pressure.

In U.S. Pat. No. 2,099,280 of Ernest H. Shaff, a radial duct is provided for conducting air carrying a quantity of grease to be distributed throughout the cylinder.

Robert W. Baily, in U.S. Pat. No. 2,148,722, shows a submersible vibrator wherein the spent motor fluid is exhausted into a space in the motor casing.

In U.S. Pat. No. 3,272,138, of Eugene N. Connoy et al, escapement of fluid from the pressure zone through a running clearance permits lubrication of the bearing. The lubricant then flows through a passage means to a hollow interior of the pump body to be exhausted therefrom through a drain port passage.

Øystein Bjørndal, in U.S. Pat. No. 3,299,825, teaches the provision of an inlet to the gears for providing a low pressure lubricant thereto.

In U.S. Pat. No. 3,395,894, of S. Hedelin, a bearing cup embraces the body and is provided with grooves for lubricant circulation. A filling hole for the lubricating oil is further provided.

In U.S. Pat. No. 3,566,915, of Willis D. Griffin, a pressure hose of a hydraulic system is enclosed within a return hose and a special coupling is provided for providing connection of both the high pressure and low pressure conduits to the work element.

In U.S. Pat. No. 3,719,251, of John R. Hedrick, a diffuser apparatus is disclosed having a central hose extending longitudinally through an outer hose.

Frank L. Burton, in U.S. Pat. No. 3,831,635, discloses coaxially arranged hoses providing a flexible sleeve at the free end of the hose for protecting the user in the event of rupture.

In U.S. Pat. No. 2,838,074, John A. Lauck discloses a fluid pressure hose having coaxially related portions to define a hose within a hose assembly for transferring fluids from a pressure source to a pressure-utilizing device.

SUMMARY OF THE INVENTION

The present invention comprehends an improved fluid-operated vibrator wherein improved means for lubricating the bearing means of an eccentric portion of the vibrator is provided.

More specifically, the invention comprehends the provision in a fluid-operated vibrator having an outer housing, a fluid-operated motor provided with a drive shaft, an eccentric, bearing means for rotatably mounting the eccentric in the housing to be driven by the drive shaft, means for delivering pressurized fluid to the motor for rotating the motor, and exhausting means for exhausting the spent fluid, of an improved lubricating means comprising duct means in the shaft for bypassing a portion of the pressurized fluid delivered to the motor therefrom into the housing to lubricate the bearing means, and return means for delivering the lubricant portion of the fluid from the bearing means to the exhausting means. In the illustrated embodiment, the motor comprises a hydraulic motor.

A bypass duct may be provided in the motor for interconnecting the fluid delivering means and the duct means.

The duct means defines a fluid flow restricting passage providing a desired pressure drop in the fluid prior to delivery therefrom to the bearing means. In the illustrated embodiment, the duct means defines a fluid passage extending from end to end of the shaft and, more specifically, defines an axial through bore in the shaft.

The exhausting means may include an exhaust passage in the motor and the return means may include means defining a second passage in the motor connected to the exhaust passage and opening into the housing for receiving the spent lubricating fluid from the bearing means.

The duct means includes a discharge end directed against the housing to cause the fluid delivered therefrom to be distributed in the housing for improved lubrication of the bearing means. More specifically, the housing may define an inner flow diverter surface and the fluid may be directed from the duct means thereagainst.

Th hydraulic fluid is delivered to and from the motor through adjacent inlet and outlet openings connected respectively to a pressurized supply portion and an exhaust portion of a conduit means defined by an outer conduit for conducting the spent fluid from the motor outlet and an inner conduit extending longitudinally through the outer conduit for conducting the pressurized fluid to the motor inlet. The outer conduit circumscribes the inlet at the motor for improved connection to the motor.

Thus, the fluid-operated vibrator structure of the present invention is extremely simple and economical of construction while yet providing the highly desirable features and advantages discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
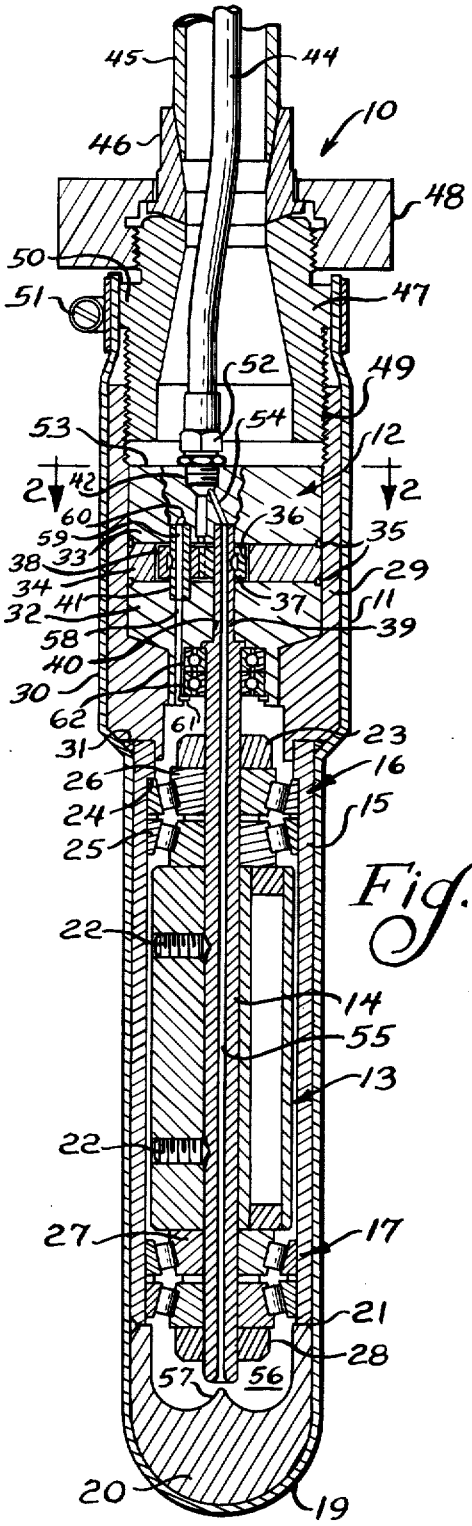
FIG. 1 is a diametric section of a fluid-operated vibrator embodying the invention.

In the exemplary embodiment of the invention as disclosed in the drawing, a fluid-operated vibrator generally designated 10 includes an outer housing 11, a hydraulic motor generally designated 12, and an eccentric generally designated 13. Th eccentric is mounted on a drive shaft 14 of the motor to be rotated within housing 11 to provide a desired vibrating action.

The drive shaft is coaxially journaled within a tubular portion 15 of the housing by a first roller bearing means generally designated 16 and a second roller bearing means generally designated 17 at the opposite ends of the eccentric. The lower end 19 of th housing is closed and receives an end piece 20 which may be secured to the tubular element 15 as by welds 21.

Eccentric 13 may be secured to the shaft 14 by suitable set screws 22.

A first retaining sleeve 23 is press fitted to the shaft 14 adjacent the upper end of housing portion 15. The housing portion is provided with a downwardly facing shoulder 24 against which the outer race 25 of bearing means 16 is abutted. The inner race 26 of the bearing 16 abuts the retaining sleeve.

The eccentric may abut the inner race 26 at its upper end, and at its lower end may abut the inner race 27 of the bearing 17 which is maintained thereagainst by a lower retaining sleeve 28 force fitted to the lower end of shaft 14. Thus, the eccentric is effectively captured between the bearings 16 and 17 and coaxially rotatable with shaft 14 within the tubular housing portion 15 as shown in FIG. 1.

A motor housing 29 is received within an enlarged portion 30 of the housing 11 and is secured to the upper end of the tubular housing portion 15 as by welds 31. Motor 12 includes a front head 32, a rear head 33, and a cylinder 34 with the cylinder being sealed to the front and rear heads and the motor housing by suitable O-rings 35. Cylinder 34 defines a gear chamber 36 rotatably receiving a pair of meshed gears 37 and 38.

Shaft 14 includes an inner end 39 extending through a bore 40 in the front head 32 and locked to gear 37. The upper end 39 of shaft 14 is journaled in a pair of roller bearings 62. Gear 38 is fixed to a stub shaft 41 having its opposite ends journaled in the front and rear heads, respectively.

Rear head 33 is provided with an inlet passage 42 which communicates with the gear chamber 36 between the gears 37 and 38. The front head is further provided with an outlet passage 43 (FIG. 2) communicating with the chamber 36 adjacent gear 38.

Pressurized hydraulic fluid is delivered to the inlet passage 42 through a supply conduit 44 and is exhausted from the outlet passage 43 through a return conduit 45.

As shown in FIG. 1, the return conduit is provided with a distal sleeve 46 sealingly coaxially clamped to a tubular body 47 by a nut 48, body 47 being threadedly secured to the motor housing by threaded means 49.

Body 47 may be provided with an outer annular flange 50 fitted within the upper end of the housing portion 29, with the housing portion clamped against the flange by means of a boot clamp 51. Thus, the return conduit 45 is effectively sealingly connected to the motor housing to receive spent hydraulic fluid from the discharge outlet 43.

Figure 2:
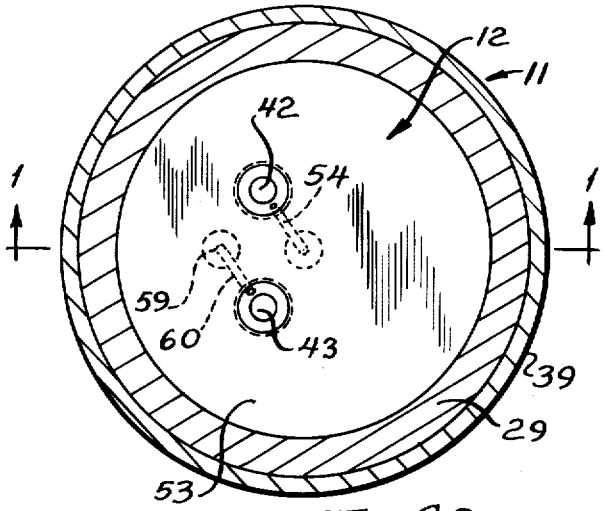
FIG. 2 is a transverse section taken substantially along the line 2—2 of FIG. 1.

As further shown in FIG. 1, supply conduit 44 is provided with a connector 52 threadedly sealingly connected to the inlet passage 42. Motor rear head 33 an upper face 53 through which each of inlet passage 42 and outlet passage 43 open. As shown in FIG. 2, the inlet and outlet passages are juxtaposed.

As indicated briefly above, the invention comprehends the bypassing of a portion of the hydraulic fluid provided for operating the hydraulic motor, with the bypass portion of the fluid serving as means for lubricating the bearings 16 and 17. More specifically, the rear head 33 is provided with a bypass passage 54 leading from inlet passage 42 to the upper end 39 of the drive shaft 14 received in the rear head 33. The drive shaft is provided with an axial through bore 55 which, at its upper end, receives the bypassed portion of the hydraulic fluid from bypass passage 54, and at its lower end, delivers the bypassed portion of the fluid into the chamber 56 at the lower end of housing 11.

As shown in FIG. 1, end piece 20 is provided with a flared diverter portion 57 aligned with the shaft bore 55 to distribute the bypassed portion of the hydraulic fluid uniformly through chamber 56 for improved delivery of the lubricant fluid to the bearings 16 and 17.

The lubricant fluid is delivered from chamber 56 above the upper bearing 16 through a passage 58 in the front head 32 which communicates with the chamber 56 at its lower end, and which communicates with a through bore 59 in the stub shaft 41. The upper end of bore 59 communicates with a transfer passage 60 in front head 32 which, at its upper end, communicates with the outlet passage 43, as illustrated in FIG. 2.

As shown, the bypas passage 54 and shaft bore 55 have a relatively small cross section as compared to the cross section of the inlet passage 42 and thus serve as a pressure dropping, flow restricting means which suitably drops the relatively high pressure of the delivered hydraulic fluid to a relatively low pressure so that the fluid may effectively lubricate the bearings 16 and 17.

Further, the provision of the improved shaft means defining a substantial extension of the lubricant flow passage means permits the lubricant fluid to be delivered to the lower end of the chamber 56 for improved delivery upwardly therethrough for improved lubrication of the bearings 16 and 17 as well as the motor bearings 62 at the upper end of the chamber 56. As shown in FIG. 1, the motor bearings 62 may be retained in the front head 32 by means of a removable locking ring 61.

Further, the provision of the passages 58, 59 and 60 in the motor 12 for conducting the spent lubricating fluid from the chamber 56 to the outlet opening 43 permits the pressure drop effected by the flow restrictiing passages 54 and 55 to be accurately preselected, thereby providing further improved lubrication of the bearings.

The provision of the supply conduit 44 within the return conduit 45 permits a facilitated connection thereof to the vibrator, as discussed above.

Thus, the vibrator 10 is extremely simple and economical of constuction while yet providing an improved lubrication of the vibrator bearings utilizing means for providing an accurately controlled pressure drop in a bypass portion of the pressurized fluid delivered to the vibrator for effecting operation of the motor thereof. The normal inlet and outlet passages of the motor may be utilized in connecting the bypass lubricant flow system to the supply conduit and return conduit respectively.

The foregoing disclosure of specific embodiments is illustrative of the broad inventive concepts comprehended by the invention.

We claim:

1. In a fluid-operated vibrator having an outer housing, a fluid-operated motor provided with a drive shaft, an eccentric on said shaft, bearing means for rotatably mounting the shaft in said housing, means for delivering pressurized fluid to said motor for rotating the motor, and exhausting means for exhausting the spent fluid, the improvement comprising:

duct means in said shaft for bypassing a portion of the pressurized fluid delivered to said motor into said housing to lubricate said bearing means; and return for delivering said lubricating portion of the fluid from the bearing means to said exhausting means.

2. The fluid-operated vibrator of claim 1 wherein said motor is provided with a bypass duct interconnecting said pressurized fluid delivering means and said duct means for conducting said fluid portion to said duct means.

3. The fluid-operated vibrator of claim 1 wherein said duct means defines a fluid flow restricting passage for providing a desired pressure drop in the fluid prior to delivery therefrom to said bearing means.

4. The fluid-operated vibrator of claim 1 wherein said motor is provided with a flow restricting bypass duct interconnecting said pressurized fluid delivering means and said duct means for conducting said fluid portion to said duct means at a desired reduced pressure.

5. The fluid-operated vibrator of claim 1 wherein said duct means defines a flow passage extending from end to end of the shaft.

6. The fluid-operated vibrator of claim 1 wherein said duct means defines an axial through bore in the shaft.

7. The fluid-operated vibrator of claim 1 wherein said exhausting means includes means defining an exhaust passage in said motor, and said return means includes means defining a second passage in said motor connected to said exhaust passage.

8. The fluid-operated vibrator of claim 1 wherein said exhausting means includes means defining an exhaust passage in said motor, and said return means includes means defining a second passage in said motor connected to said exhaust passage. and opening into said outer housing.

9. The fluid-operated vibrator of claim 1 wherein said motor is disposed within said housing.

10. The fluid-operated vibrator of claim 1 wherein said duct means includes a discharge end directed toward said housing to cause the fluid delivered therefrom to be distributed in the housing for improved lubrication of the bearing means therein.

11. The fluid-operated vibrator of claim 1 wherein said housing defines an inner flow diverter surface and said duct means includes a discharge end directed toward said flow diverter surface to cause the fluid delivered therefrom to be distributed in the housing for improved lubrication of the bearing means therein.

12. The fluid-operated vibrator of claim 1 wherein said exhausting means includes a first duct connected to said motor, and said fluid delivery means comprises a second duct connected to said motor and extending longitudinally through said first duct.

13. In a fluid-operated vibrator having a fluid-operated motor provided with an inlet for receiving pressurized fluid to the motor and an outlet adjacent said inlet for discharging spent fluid from the motor, the improvement comprising means for conducting fluid to and from the motor having an outer conduit means for conducting the spent fluid from the motor outlet, and an innerconduit means extending longitudinally through said outer conduit means for conducting the pressurized fluid to said motor inlet, said outer conduit means circumscribing said inlet at said motor.

14. The fluid-operated vibrator of claim 13 wherin said motor defines an end faceand said inlet and outlet are juxtaposed to open through said end face.

15. The fluid-operated vibrator of claim 13 wherein said motor defines an end face and said inlet and outlet are juxtaposed to open parallel to each other through said end face.

16. The fluid-operated vibrator of claim 13 wherein said vibrator includes bearing means externally of said motor and means for conducting a portion of the pressurized fluid from said inlet through said motor to said bearing means and means for conducting said portionn from said bearing means through said motor to said outlet.

* * * * *